US006464579B1

(12) United States Patent
Salazar

(10) Patent No.: US 6,464,579 B1
(45) Date of Patent: Oct. 15, 2002

(54) ROTATABLE AIR VENT

(76) Inventor: Joshua A. Salazar, 11832 Gloucester Ct., Rancho Cucamonga, CA (US) 91730

( * ) Notice: Subject to any disclaimer, the term of this patent is extended or adjusted under 35 U.S.C. 154(b) by 0 days.

(21) Appl. No.: 09/871,791

(22) Filed: Jun. 1, 2001

(51) Int. Cl.[7] ..... F24F 13/075
(52) U.S. Cl. ..... 454/316; 454/202; 454/299
(58) Field of Search ..... 454/155, 202, 454/299, 316, 285; 294/19.1; 81/3.07

(56) References Cited

U.S. PATENT DOCUMENTS 2,472,748 A * 6/1949 Labus ..... 454/316
2,824,429 A * 2/1958 Zucker ..... 392/360
2,996,972 A * 8/1961 Johansson ..... 454/316
3,030,872 A * 4/1962 Brugler ..... 454/316
4,203,332 A * 5/1980 Corsetti ..... 294/19.1
5,971,847 A * 10/1999 Webb ..... 454/290
6,176,775 B1 * 1/2001 Volk ..... 454/154

FOREIGN PATENT DOCUMENTS

JP 8-94119 * 4/1996

* cited by examiner

*Primary Examiner*—Harold Joyce
(74) *Attorney, Agent, or Firm*—Goldstein & Lavas, P.C

(57) ABSTRACT

A rotatable air vent including an outer circular housing having an inner surface and an outer surface. The outer circular housing has an interior ring rotatably coupled with the inner surface. The interior ring has a plurality of inwardly extending radial connectors secured thereto in a spaced relationship. An inner ring is disposed within the outer circular housing. The inner ring has an inner surface and an outer surface. The outer surface is secured to the radial connectors. A plurality of blades extend within the inner ring.

6 Claims, 3 Drawing Sheets

ROTATABLE AIR VENT

BACKGROUND OF THE INVENTION

The present invention relates to a rotatable air vent and more particularly pertains to allowing the flow of air to be adjusted 360 degrees.

The use of ventilation systems is known in the prior art. More specifically, ventilation systems heretofore devised and utilized for the purpose of controlling the discharge of air are known to consist basically of familiar, expected and obvious structural configurations, notwithstanding the myriad of designs encompassed by the crowded prior art which have been developed for the fulfillment of countless objectives and requirements.

By way of example, U.S. Pat. No. 2,909,112 to Yousoufian discloses an air diffuser used with a duct work system and is capable of adjusting the air flow into a number of directions. Yousoufian additionally appears to show a series of four rotatable circular members with vanes for providing various air distribution requirements. U.S. Pat. No. 2,640,412 to Sweger discloses an adjustable grill with the discharge of air controlled by individually adjustable vanes. U.S. Pat. Nos. 4,991,496 to Kuno and 5,109,756 to Barboza disclose additional adjustable air diffuser devices.

While these devices fulfill their respective, particular objective and requirements, the aforementioned patents do not describe a rotatable air vent for allowing the flow of air to be adjusted 360 degrees.

In this respect, the rotatable air vent according to the present invention substantially departs from the conventional concepts and designs of the prior art, and in doing so provides an apparatus primarily developed for the purpose of allowing the flow of air to be adjusted 360 degrees.

Therefore, it can be appreciated that there exists a continuing need for a new and improved rotatable air vent which can be used for allowing the flow of air to be adjusted 360 degrees. In this regard, the present invention substantially fulfills this need.

SUMMARY OF THE INVENTION

In the view of the foregoing disadvantages inherent in the known types of ventilation systems now present in the prior art, the present invention provides an improved rotatable air vent. As such, the general purpose of the present invention, which will be described subsequently in greater detail, is to provide a new and improved rotatable air vent which has all the advantages of the prior art and none of the disadvantages.

To attain this, the present invention essentially comprises an outer circular housing having an inner surface and an outer surface. The inner surface has a plurality of inwardly extending radial connectors secured thereto in a spaced relationship. An inner ring is disposed within the outer circular housing. The inner ring has an inner surface and an outer surface. The outer surface is secured to the radial connectors. The inner ring has an interior ring rotatably coupled with the inner surface. A plurality of blades extend within the interior ring. The plurality of blades include a central blade diametrically disposed within the interior ring. The central blade has a tab member extending outwardly therefrom. An adjustment tool is adapted for coupling with the plurality of blades to facilitate rotation of the interior ring with respect to the inner ring. The adjustment tool includes a handle portion having an open-ended head secured thereto. The open-ended head receives the tab member of the central blade therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rotatable air vent which has all the advantages of the prior art ventilation systems and none of the disadvantages.

It is another object of the present invention to provide a new and improved rotatable air vent which may be easily and efficiently manufactured and marketed.

It is a further object of the present invention to provide a new and improved rotatable air vent which is of durable and reliable construction.

An even further object of the present invention is to provide a new and improved rotatable air vent which is susceptible of a low cost of manufacture with regard to both materials and labor, and which accordingly is then susceptible of low prices of sale to the consuming public, thereby making such a rotatable air vent economically available to the buying public.

Even still another object of the present invention is to provide a new and improved rotatable air vent for allowing the flow of air to be adjusted 360 degrees.

Lastly, it is an object of the present invention to provide a new and improved rotatable air vent including an outer circular housing having an inner surface and an outer surface. The outer circular housing has an interior ring rotatably coupled with the inner surface. The interior ring has a plurality of inwardly extending radial connectors secured thereto in a spaced relationship. An inner ring is disposed within the outer circular housing. The inner ring has an inner surface and an outer surface. The outer surface is secured to the radial connectors. A plurality of blades extend within the inner ring. These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
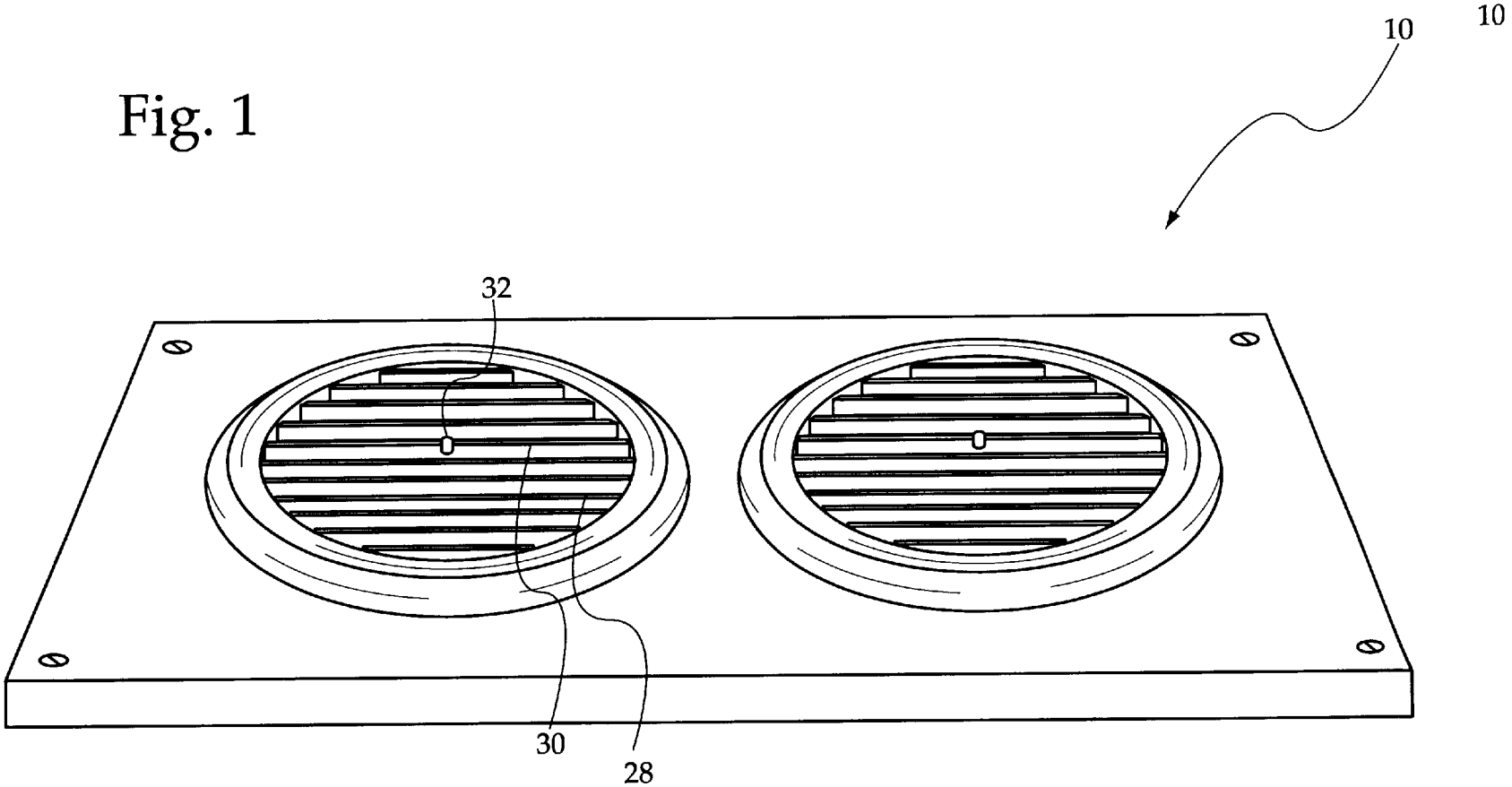
FIG. 1 is a perspective view of the preferred embodiment of the rotatable air vent constructed in accordance with the principles of the present invention.

With reference now to the drawings, and in particular, to FIGS. 1 through 4 thereof, the preferred embodiment of the new and improved rotatable air vent embodying the principles and concepts of the present invention and generally designated by the reference number 10 will be described.

Specifically, it will be noted in the various figures that the device relates to a rotatable air vent for allowing the flow of air to be adjusted 360 degrees. In its broadest context, the device consists of an outer circular housing, an inner ring, a plurality of blades, and an adjustment tool. Such components are individually configured and correlated with respect to each other so as to attain the desired objective.

The outer circular housing 12 has an inner surface 14 and an outer surface 16. The inner surface 14 has an interior ring 18 rotatably coupled therewith. The interior ring 18 has a plurality of inwardly extending radial connectors 20 secured thereto in a spaced relationship.

An inner ring 22 is disposed within the outer circular housing 12. The inner ring 22 has an inner surface 24 and an outer surface 26. The outer surface 26 is secured to the radial connectors 20.

The plurality of blades 28 extend within the inner ring 22. The plurality of blades 28 include a central blade 30 diametrically disposed within the inner ring 22. The central blade 30 has a tab member 32 extending outwardly therefrom. Note FIG. 3.

The adjustment tool 34 is adapted for coupling with the plurality of blades 28 to facilitate rotation of the interior ring 18 with respect to the outer circular housing 12. Note FIG. 4. The adjustment tool 34 includes a handle portion 36 having an open-ended head 38 secured thereto. The open-ended head 38 receives the tab member 32 of the central blade 30 therein. By attaching the adjustment tool 34 to the tab member 32, a user can rotate the positioning of the blades 30 by turning the adjustment tool 34.

Figure 2:
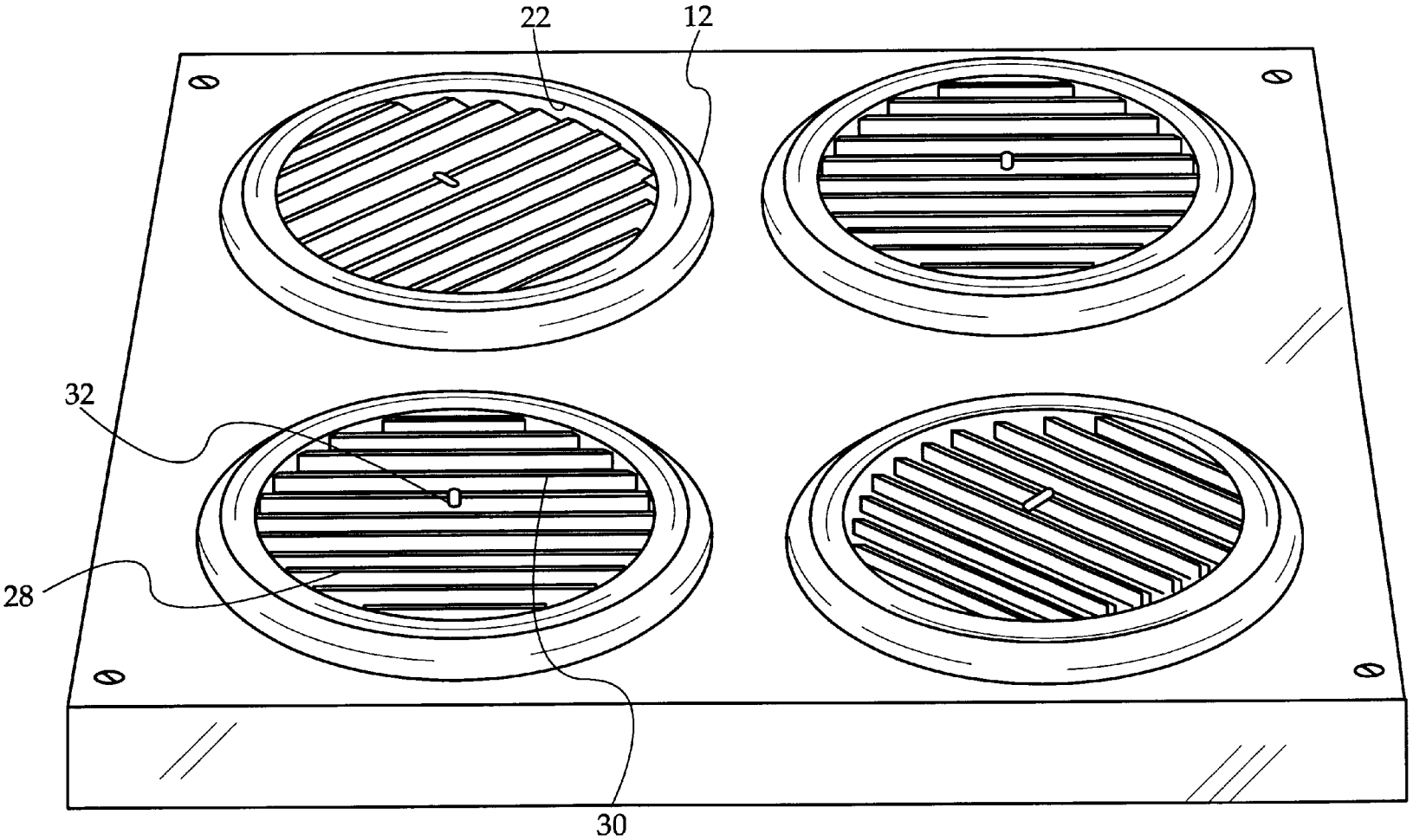
FIG. 2 is a perspective view of the present invention illustrated with four air vents.
Figure 3:
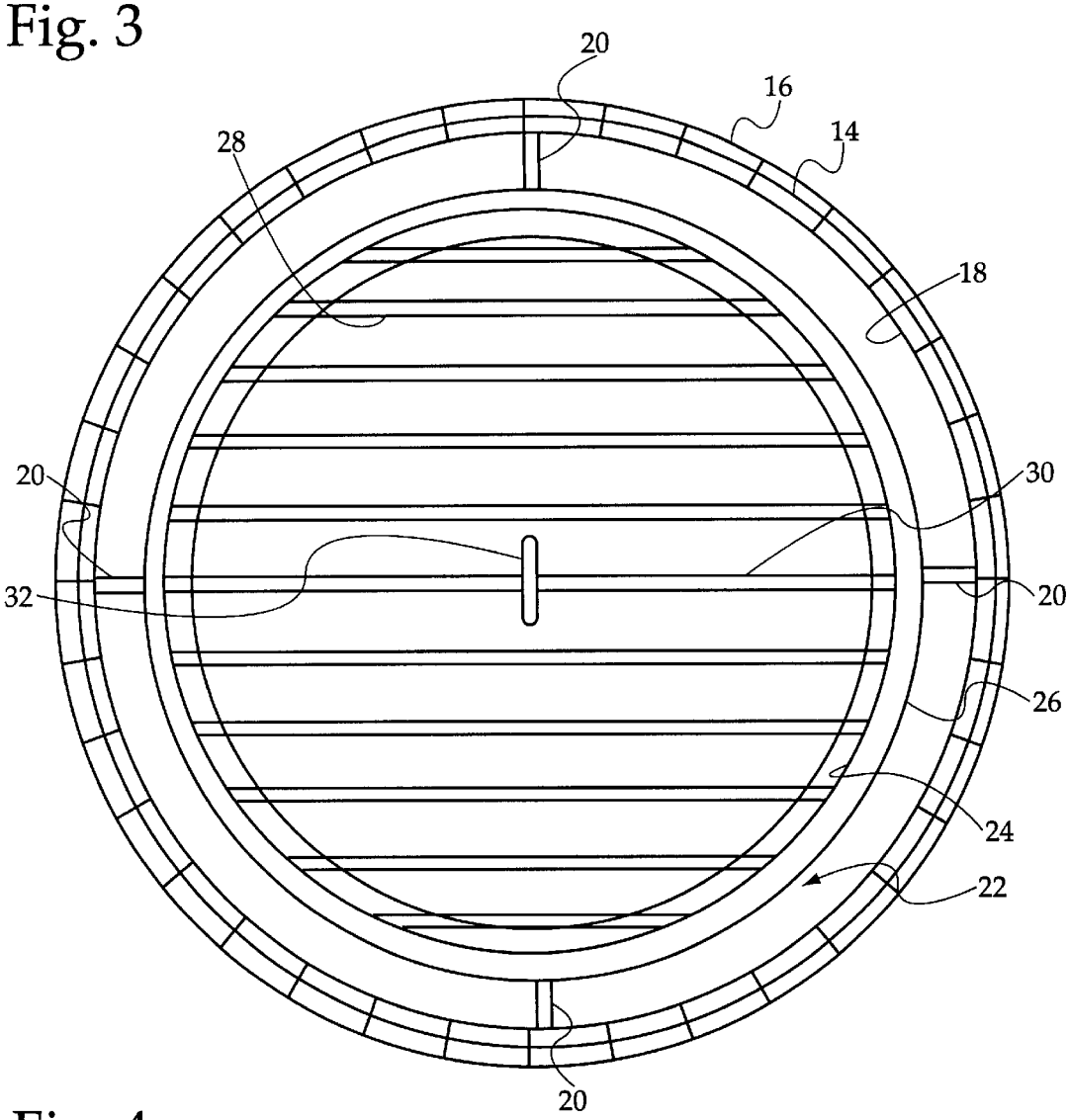
FIG. 3 is a top plan view of the present invention.
Figure 4:
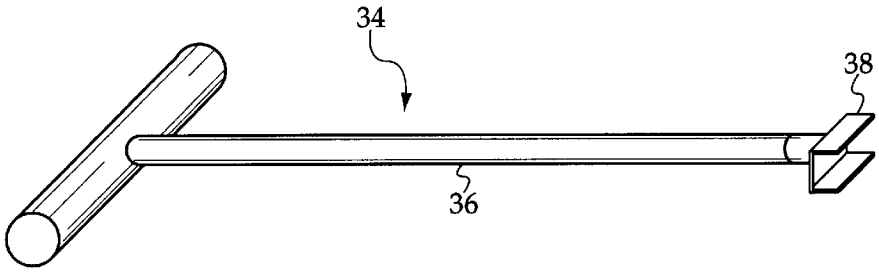
FIG. 4 is a perspective view of the adjustment tool of the present invention.

The present invention, as illustrated in FIGS. 1 and 2, can be situated in series of two and four units. It should be noted that this is merely illustrative of the myriad of configurations in which the present invention can be utilized.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rotatable air vent for allowing the flow of air to be adjusted 360 degrees comprising, in combination:

an outer circular housing having an inner surface and an outer surface, the inner surface having an interior ring rotatably coupled therewith, the interior ring having a plurality of inwardly extending radial connectors secured thereto in a spaced relationship;

an inner ring disposed within the outer circular housing, the inner ring having an inner surface and an outer surface, the outer surface being secured to the radial connectors;

a plurality of blades extending within the inner ring, the plurality of blades including a central blade diametrically disposed within the inner ring, the central blade having a tab member extending outwardly therefrom; and an adjustment tool adapted for coupling with the plurality of blades to facilitate rotation of the interior ring with respect to the outer circular housing, the adjustment tool including a handle portion having an open-ended head secured thereto, the open-ended head receiving the tab member of the central blade therein.

2. A rotatable air vent for allowing the flow of air to be adjusted 360 degrees comprising, in combination:

an outer circular housing having an inner surface and an outer surface, the inner surface having an interior ring rotatably coupled therewith, the interior ring having a plurality of inwardly extending radial connectors secured thereto in a spaced relationship;

an inner ring disposed within the outer circular housing, the inner ring having an inner surface and an outer surface, the outer surface being secured to the radial connectors; and a plurality of blades extending within the inner ring.

3. The rotatable air vent as set forth in claim 2, wherein the plurality of blades include a central blade diametrically disposed within the inner ring.

4. The rotatable air vent as set forth in claim 3, wherein the central blade has a tab member extending outwardly therefrom.

5. The rotatable air vent as set forth in claim 4, and further including an adjustment tool adapted for coupling with the plurality of blades to facilitate rotation of the interior ring with respect to the outer circular housing.

6. The rotatable air vent as set forth in claim 5, wherein the adjustment tool includes a handle portion having an open-ended head secured thereto, the open-ended head receiving the tab member of the central blade therein.

* * * * *